United States Patent [19]

Wagner

[11] Patent Number: 4,660,338

[45] Date of Patent: Apr. 28, 1987

[54] SEALING ELEMENT FOR COMPONENTS OF BUILDINGS

[76] Inventor: Hugo Wagner, Kapuzinerstrasse 84, A-4020 Linz, Austria

[21] Appl. No.: 733,126

[22] Filed: May 10, 1985

[30] Foreign Application Priority Data

May 17, 1984 [AT] Austria ..... 1630/84

[51] Int. Cl.[4] ..... E04C 2/00

[52] U.S. Cl. ..... 52/232; 49/504

[58] Field of Search ..... 52/232; 49/504, 475

[56] References Cited

U.S. PATENT DOCUMENTS

| | | | |
|---|---|---|---|
| 3,566,541 | 3/1971 | Coulter | 49/504 X |
| 4,045,930 | 9/1977 | Dixon | 49/504 X |
| 4,246,304 | 1/1981 | Dixon | 52/232 X |
| 4,307,543 | 12/1981 | Schulthess | 52/232 X |

FOREIGN PATENT DOCUMENTS

| | | | |
|---|---|---|---|
| 353460 | 11/1979 | Austria . | |
| 2800275 | 11/1978 | Fed. Rep. of Germany | 49/504 |
| 2842394 | 4/1980 | Fed. Rep. of Germany | 49/504 |
| 7613604 | 6/1977 | Netherlands | 52/232 |

*Primary Examiner*—Carl D. Friedman
*Assistant Examiner*—Naoko N. Slack
*Attorney, Agent, or Firm*—Lackenbach Siegel Marzullo & Aronson

[57] ABSTRACT

A sealing element for use with components of buildings, such as wall and floor elements, doors or the like, comprises an at least partly enclosed barrier strip consisting of a material which is self-foamable under the action of heat, e.g., a sodium silicate material. The sealing element comprises an integral plastic bar having at least one plastic strip portion, which has two opposite sealing surfaces, and the barrier strip extends along one sealing surface in a preferably dovetail-shaped groove or in a cavity of the plastic strip portion.

4 Claims, 9 Drawing Figures

SEALING ELEMENT FOR COMPONENTS OF BUILDINGS

BACKGROUND OF THE INVENTION

1. Field of the Invention

This invention relates to a sealing element for use with components of buildings, such as wall and floor elements, doors or the like, comprising an at least partly enclosed carrier strip consisting of a material which is self-foamable under the action of heat, e.g., a sodium silicate material.

2. Description of the Prior Art

A sealing element of this kind for use with doors has been disclosed in Austrian Patent Specification No. 353,460. That known sealing element comprises a substantially channel-shaped sheet metal bar, which contains a layer that is adapted to foam under the action of heat. A special design of the sheet metal bar with flanges at its legs has been proposed in order to facilitate the expansion of the bar in case of a fire. A sealing rubber element for contacting the door leaf is provided in addition to said fire barrier seal.

The use of a special sheet metal bar is expensive and its installation is complicated. Problems arise also owing to the expansion of the bar, as is apparent from Austrian Patent Specification No. 353,460. If a sheet metal is selected which is too strong, the bar may not be able to expand. Bars made of thinner sheet metal may easily be bent or may protrude in the course of time so that the function of the door will be adversely affected.

In connection with doors, particularly with fire barrier doors, it is known to provide sealing elements comprising a profiled plastic bar, which has a sealing base portion adapted to be inserted into a groove of the door frame and a sealing lip for engaging the door leaf or the door stop. To install such known sealing elements, the base portion is inserted into a groove of the door frame and in most cases extends around the entire door frame. In such a case the sealing lip effects a seal between the door frame and the marginal portion of the forward or rear side of the door leaf. In door frames made of wood, the base portion of the sealing element extends in a relatively narrow groove that has been milled into the door frame. in door frames made of steel the groove is formed in the profiled sheet metal bar of the frame and is usually wider than in door frames of wood and often flares toward the bottom of the groove.

Such sealing elements may be used also with fire barrier doors but this will involve certain disadvantages. In the first place the plastics usually employed for such sealing elements assume the plastically deformable semisolid consistency at elevated temperature so that their sealing action will be adversely affected. In a second place a gap is left between the door frame and the edges of the door leaf and flue gases and flames may pass through that gap. Such gap cannot be avoided, particularly with door leaves having no rabbet. The gap is the result of inevitable tolerances and is required to facilitate the opening and closing of the door.

Other doors are known, which are effectively sealed and do not define open gaps. But said known doors are highly expensive because they require door frames having intricate profiled shapes and also require a plurality of sealing elements.

SUMMARY OF THE INVENTION

It is an object of the invention to provide a sealing element which can easily expand in case of a fire and which is in resilient contact with the surface to be sealed and which will not be bent or protrude in the course of time as is the case with a sheet metal bar.

With a sealing element of the kind described first hereinbefore this object can be accomplished in that in accordance with the invention the sealing element comprises an integral plastic bar having at least one plastic strip portion, which has two opposite sealing surfaces, and the barrier strip extends along one sealing surface in a preferably dovetail-shaped groove or in a cavity of the plastic strip portion.

The sealing element in accordance with the invention can be installed just as simply as the known sealing elements. When the sealing element is heated in case of a fire, the barrier strip will foam so that any gap which may exist or which may form under the action of heat between the components to be sealed will be closed and a passage of flue gases and flames will be prevented. An advantage resides in the fact that the plastic bar will lose its strength under the action of heat to assume a semisolid state so that the barrier strip can more easily expand, particularly when the barrier strip is entirely or substantially enclosed by the plastic strip portion.

In one embodiment the plastic strip portion contains a longitudinally extending cavity and is formed with a slot through which said cavity communicates with the outside, and the barrier strip extends in said cavity. That embodiment affords the advantage that the barrier strip having a lower mechanical strength than the plastic bar is effectively protected regardless of the manner in which the sealing element is secured to the component of the building. Besides, such a sealing element can be made more easily and the foaming in case of a fire will be facilitated.

The disadvantages of known doors provided with plastic sealing bars have been discussed hereinbefore. These disadvantages can be avoided in a sealing element of the kind described hereinbefore by the provision of a longitudinally extending leg, which protrudes from the base portion and consists of a plastic strip portion, which is preferably biased toward the door frame and in which the barrier strip is contained. Such a sealing element affords the advantage that a gap which is provided for the proper function of the door may be left under normal conditions between the door frame or the longitudinal leg of the sealing element and the edge of the door leaf and that the barrier strip will foam in the case of a fire so as to close said gap.

DETAILED DESCRIPTION OF THE PREFERRED EMBODIMENTS

Figure 1:
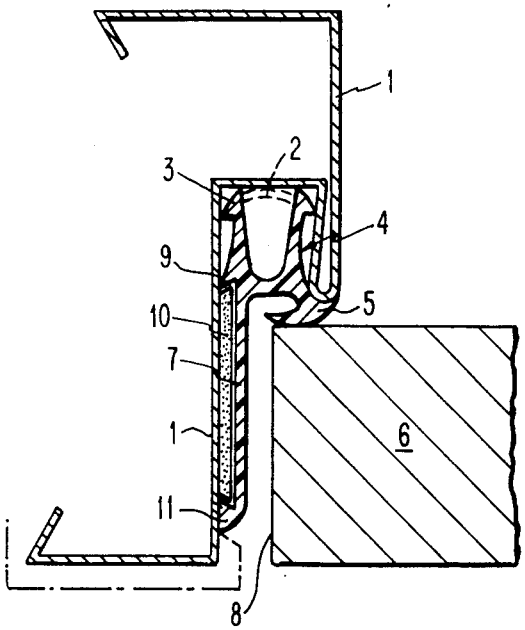
FIG. 1 is a horizontal sectional view showing a door frame provided with an installed sealing element in accordance with the invention and a portion of the door leaf in its closed position.

The invention and further advantages and features thereof will now be explained more in detail with reference to illustrative embodiments shown on the drawing.

FIG. 1 shows a door frame 1 made of steel and formed with a groove 2, which contains the base portion 3 of a plastic sealing bar 4, which extends around the entire door frame. The enlarged groove 2 flares in width toward its bottom so that the elastic base portion of the sealing element will be effectively retained in the groove. The base portion 3 may be open at its bottom or may be closed at its bottom, as is indicated by dotted lines in FIG. 1. The sealing element 4 is provided in a manner known per se with a sealing lip 5, which is integral with the base portion 3 and is engaged by the door leaf 6 when the door is closed. The sealing lip 5 may be joined to the base portion 3 only on one side, as is shown on the drawing, or may join the base portion 3 on both sides to form a tubular sealing element.

A longitudinally extending leg 7, which constitutes a plastic strip portion, extends from the base portion 3 and engages the door frame 1 and when the door is closed extends between an edge 8 of the door leaf and the door frame 1. On that side which faces the door frame 1 the leg 7 is formed with a groove 9, which contains a barrier strip 10 made of a material which is foamable under the action of heat. Such material consists, e.g., of sodium silicate. The groove 9 is dovetail-shaped so that the barrier strip 10 is firmly retained in the groove without a need for an adhesive. As is indicated by dotted lines a profiled door frame made of steel may be so designed that the leg 7 does not protrude from the door frame 1 so that that leg will be protected more effectively from mechanical stress.

Figure 2:
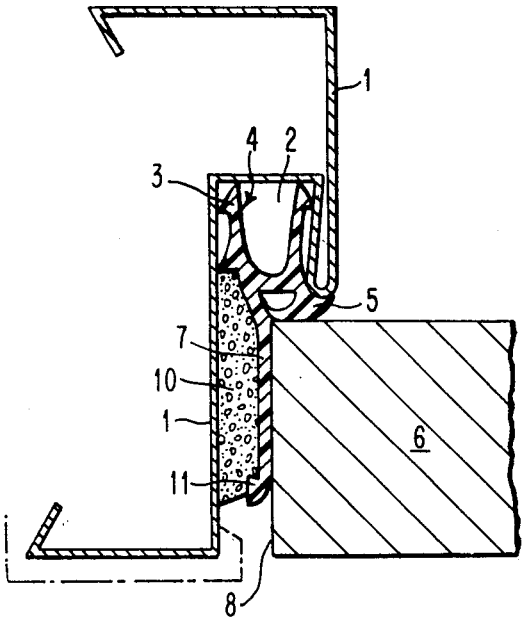
FIG. 2 is a view that is similar to FIG. 1 but shows the arrangement after the foaming of the barrier strip.

When a door provided with a sealing element in accordance with the invention is exposed to a fire acting from the inside or outside, the barrier strip 10 will foam, as is indicated in FIG. 2. Under the action of the heat the sealing bar of plastic assumes a soft to semisolid consistency so that the expansion of the barrier strip 10 will be facilitated and its sealing action will be improved.

It is recommendable to arrange the leg 7 of the sealing element 4 so that said leg is biased toward the door frame 1 and the forward edge 11 of the leg 7 will always be forced against the door frame so that the function of the door will not be adversely affected.

Figure 3:
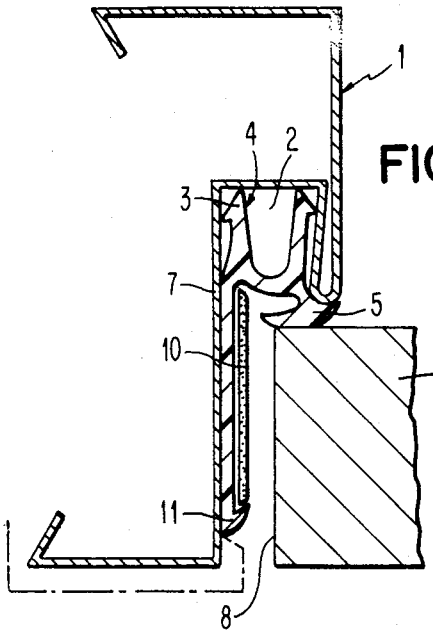
FIG. 3 is a view that is similar to FIG. 1 and illustrates another embodiment of the sealing element in accordance with the invention used to seal a door.

The barrier strip 10 need not be located on that side of the leg 7 which faces the door frame 1. As is apparent from FIG. 3 the barrier strip 10 may alternatively be disposed on that side of that leg which faces the edge 8 of the door leaf. Alternatively, the barrier strip 10 may be entirely accommodated in the leg 7 so that the barrier strip 10 is entirely enclosed by the sealing material and the barrier strip 10 will be effectively protected from mechanical stress.

Figure 4:
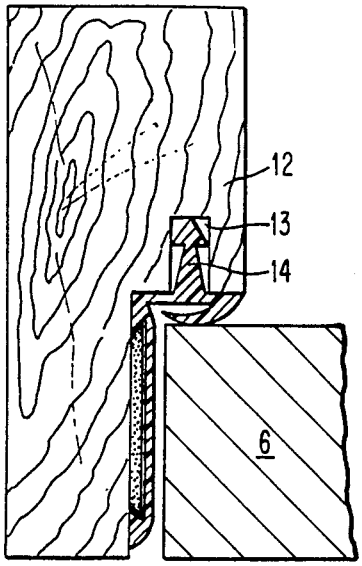
FIG. 4 is a view that is similar to FIG. 1 and shows a further embodiment of a sealing element in accordance with the invention in a door frame made of wood.

It will be understood that the sealing element in accordance with the invention may similarly be used with doors of wood or door frames made of wood. In that case the base portion is usually narrower because door frames made of wood are formed with narrower milled grooves. Such an embodiment is illustrated in FIG. 4, which shows a door frame 12 made of wood and formed with a milled narrow longitudinal groove 13. For this reason the profiled plastic element 4 has a narrower base portion 14. In other respects the sealing element is similar to that shown in FIGS. 1 and 2.

The longitudinally extending leg 7 has desirably but not necessarily a width that is equal to the thickness of the door leaf. The barrier strip 10 suitably extends over a major portion of the width of the longitudinally extending leg 7. But the sealing element will also be effective if the barrier strip 10 is much narrower than the leg 7.

Figure 5:
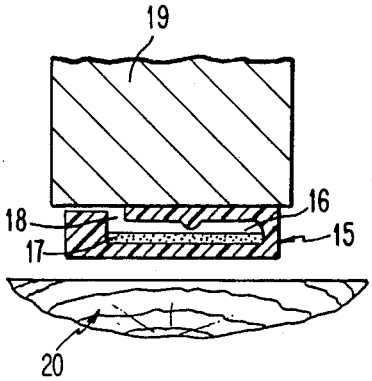
FIG. 5 shows a further embodiment of the sealing element used at the lower edge of a door.

FIG. 5 shows a sealing element in accordance with the invention comprising a plastic bar which consists only of a plastic strip portion 15, which is formed with a longitudinally extending cavity, which is preferably continuous, although this is not essential. That cavity contains a barrier strip 17 made of a material which is foamable under the action of heat. The cavity 16 communicates with the outside through a slot, which extends along the plastic strip portion 15.

It is apparent that the plastic strip portion 15 is secured, e.g., to the lower edge of a door leaf 19, e.g., by means of an adhesive, screws or staples, but the plastic strip portion 15 is sufficiently spaced from the floor 20 to ensure that the movement of the door leaf 19 will not be adversely affected. In case of a fire the barrier strip 17 will foam so that the plastic strip portion 15 will increase in volume, particularly in thickness, and will then effectively seal the gap between the door leaf 19 and the floor 20. The slot 18 facilitates the expansion of the plastic strip portion 15 and facilitates also the insertion of the barrier strip 17 into the cavity 16.

Figure 6:
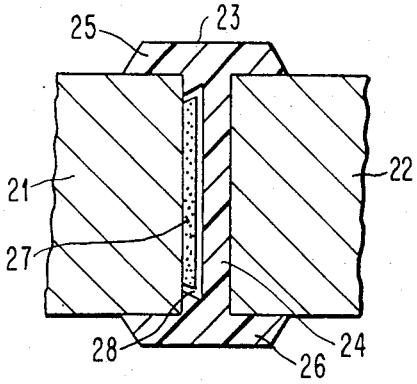
FIG. 6 shows a further embodiment of the sealing element provided between two platelike components.

FIG. 6 shows two abutting components 21, 22 and a sealing element in accordance with the invention disposed between said components. The sealing element consists of an I-section plastic bar 23 having a plastic strip portion 24, which is formed by the web of the bar and disposed between the abutting edges of the components 21, 22. One-half of each flange 25, 26 of the bar extends over one of the elements 21 and 22. At one sealing surface of the plastic strip portion 24 the barrier strip 27 which is foamable under the action of heat extends in a dovetail groove 28, as has been shown in FIG. 1 to 4.

Whereas the plastic strip portion 24 will effectively seal the gap between components 21, 22, the heat generated in case of a fire may result in a distortion of the platelike components 21, 22 so that said gap may be enlarged. But the action of the heat will cause the barrier strip 27 to foam so as to ensure the maintenance of an effective seal between the components 21, 22 and the passage of flames and flue gases will be inhibited. It will be understood that in this embodiment the barrier strip 27 may also be disposed inside the plastic strip portion 24 as is shown in FIG. 6.

Figure 7:
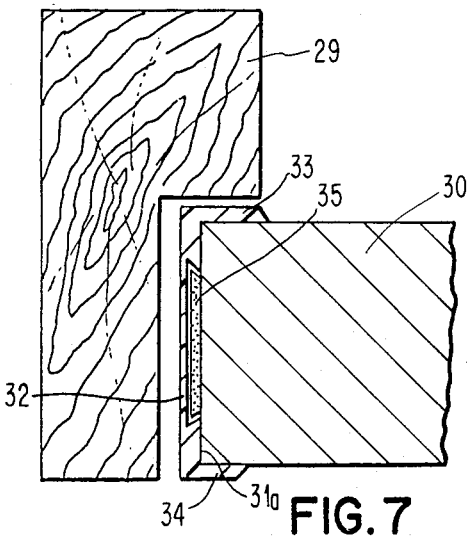
FIG. 7 shows an embodiment of the invention provided on a door leaf or on a stationary component.

FIG. 7 shows a door frame 29 made of wood and a door leaf 30. The plastic bar 31a of a sealing element is secured to the edge 31 of the door leaf. Plastic bar 31a is channel-shaped and comprises a web, which constitutes the plastic strip portion 32, and two legs 33, 34 extending over the door leaf 30. A barrier strip 35, which foams under the action of heat, extends in a dovetail groove formed in the plastic strip portion 32 on that side thereof which faces the edge 31 of the door leaf.

A difference between the embodiment of FIG. 7 and the embodiments of FIGS. 1 to 4 is that the sealing element shown in FIG. 7 is secured to the movable component, i.e., to the door leaf 30, while the sealing element shown in FIGS. 1 to 4 is secured to the stationary element, i.e., the door frame 1. But the sealing element shown in FIG. 7 could also be used at a corner joint between two stationary components.

Figure 8:
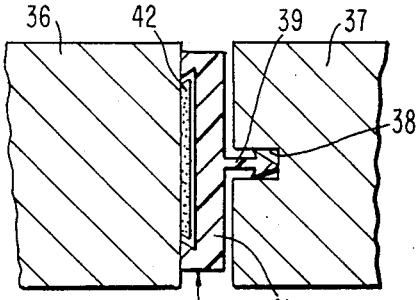
FIG. 8 shows a further embodiment of the invention used with two abutting components.

The sealing element shown in FIG. 8 is disposed between two components 36, 37, which may be stationary or may consist of a door frame and a sliding door, respectively. The component 37 is formed with a longitudinal groove 38, in which a base portion 39 of a plastic sealing bar 40 is retained. The bar 40 comprises also a plastic strip portion 41, which in one of its sealing surfaces is formed with a dovetail groove containing barrier strip 42 of a material which is foamable under the action of heat.

Figure 9:
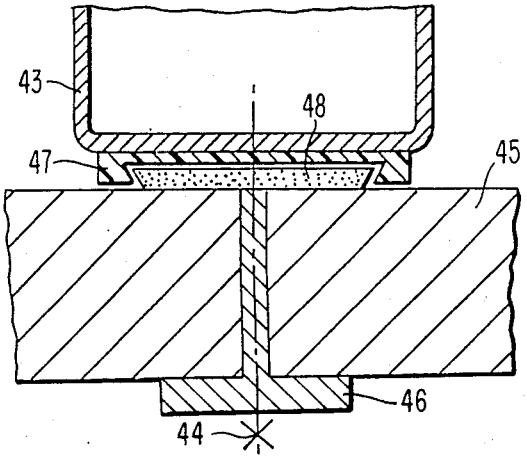
FIG. 9 illustrates the use of a further sealing element in accordance with the invention.

FIG. 9 shows a steel structure 43 and a wall element 45 secured to the structure 43 by a screw joint indicated at 44. The screw joint may be replaced by a cover bar 46. A sealing element in accordance with the invention comprising a plastic bar is disposed between the steel structure 43 and the wall element 45. That plastic bar consists only of a plastic strip portion 47, which is formed in one of its two sealing surfaces with a dovetail groove containing a barrier strip 48. The sealing bar 47 is gripped between the steel structure 43 and the wall element 45 and may serve as a seal to prevent an air draft and a conduction of heat or as a vibration damper or as a compensating surface for irregularities. In case of a fire the sealing element in accordance with the invention is to constitute a barrier against a passage of flue gases and flames even when the clearance between the steel structure 43 and the wall element 45 has been increased by a distortion under the action of heat. That barrier function is ensured in that the barrier strip 48 will foam under the action of heat. It will be understood that the barrier strip 48 might alternatively be disposed in a cavity of a plastic strip portion 47 in the manner shown in FIG. 5.

It has been found in practice that advantages are afforded by the provision of a barrier strip which is positively retained in the plastic strip portion. But it is also possible to install the barrier strip on the site between the plastic bar and a component of the building, or to attach a barrier strip by means of an adhesive or by staples or other suitable means to at least one sealing surface of the plastic strip portion.

I claim:

1. A sealing system such as for use between a door frame and a door, comprising, in combination, said door frame having a side and said door having an edge defining a space therebetween when the door is closed, said door frame being formed with a U-shaped channel having an opening parallel to said edge, a resilient plastic sealing element including a base portion positioned in an at least partially enclosed by said U-shaped channel and a leg portion extending from said base portion in said space, said base portion including a sealing lip for engaging said door when said door is closed, said leg portion having a dovetail-shaped groove on at least one side, a self-forming barrier strip,having opposite sealing surfaces,positioned in said dovetail groove along said side and being foamable under the action of heat,said leg portion and said barrier strip being spaced away from said edge, first retaining means for holding said base portion in said U-shaped channel, and said dovetail groove being formed on one side of said leg portion, and said self-forming barrier strip is positioned in said dovetail groove adjacent said one side, said base portion, said leg portion, and said sealing lip being integrally formed of a plastic which becomes soft to semi-solid under the action of heat so as to facilitate said sealing system, and whereby when heat causes said barrier strip to foam, the foaming barrier strip forces the leg portion into contact with said edge.

2. The sealing system according to claim 1, wherein a further dovetail groove is formed on the side of the leg portion facing said edge, and a further barrier strip means is positioned in said further dovetail groove facing said edge.

3. A sealing system according to claim 2 wherein said first retaining means is said U-shaped channel, and said channel being wider at the opening than at the base, and whereby said biasable space portion is retained in said U-shaped channel.

4. The sealing system according to claim 1, wherein said leg portion of said resilient plastic sealing element is always biased towards said door without adversely affecting the function of said door.

* * * * *